US009659694B2

(12) United States Patent
Ma et al.

(10) Patent No.: US 9,659,694 B2
(45) Date of Patent: May 23, 2017

(54) NON-ORIENTED ELECTRICAL STEEL PLATE AND MANUFACTURING PROCESS THEREFOR

(75) Inventors: Aihua Ma, Shanghai (CN); Bo Wang, Shanghai (CN); Xiandong Liu, Shanghai (CN); Liang Zou, Shanghai (CN); Shishu Xie, Shanghai (CN); Hongxu Hei, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 216 days.

(21) Appl. No.: 14/372,709

(22) PCT Filed: Mar. 27, 2012

(86) PCT No.: PCT/CN2012/000382

§ 371 (c)(1),
(2), (4) Date: Jul. 16, 2014

(87) PCT Pub. No.: WO2013/134895

PCT Pub. Date: Sep. 19, 2013

(65) Prior Publication Data

US 2014/0377124 A1 Dec. 25, 2014

(30) Foreign Application Priority Data

Mar. 15, 2012 (CN) ..... 2012 1 0068984

(51) Int. Cl.
*H01F 1/147* (2006.01)
*C22C 38/06* (2006.01)
(Continued)

(52) U.S. Cl.
CPC ..... *H01F 1/14775* (2013.01); *B21B 1/00* (2013.01); *C21D 6/008* (2013.01); *C21D 8/12* (2013.01);
(Continued)

(58) Field of Classification Search
CPC ..... H01F 1/14775; H01F 1/14791; C32D 8/1233; C32D 8/1261; C22C 38/004
See application file for complete search history.

(56) References Cited

U.S. PATENT DOCUMENTS 5,062,906 A * 11/1991 Nishimoto ..... C21D 8/1222 148/110
5,803,989 A 9/1998 Kawamata et al.

FOREIGN PATENT DOCUMENTS

CN 1590567 A * 3/2005
CN 1611616 A 5/2005
(Continued)

OTHER PUBLICATIONS

PCT International Preliminary Report on Patentability and Written Opinion for PCT Application No. PCT/CN2012/000382 mailed Sep. 16, 2014 (27 pages).
(Continued)

*Primary Examiner* — Jessee Roe
*Assistant Examiner* — Anthony Liang
(74) *Attorney, Agent, or Firm* — Eversheds-Sutherland (US) LLP

(57) ABSTRACT

Disclosed are a non-oriented electrical steel plate with low iron loss and high magnetic conductivity and a manufacturing process therefor. The casting blank of the steel plate comprises the following components: Si: 0.1-2.0 wt %, Al: 0.1-1.0 wt %, Mn: 0.10-1.0 wt %, C: ≤0.005 wt %, P: ≤0.2 wt %, S: ≤0.005 wt %, N: ≤0.005 wt %, the balance being Fe and unavoidable impurities. The magnetic conductivity of the steel plate meets the following relationship formula: $\mu_{10}+\mu_{13}+\mu_{15}\geq 13982-586.5P_{15/50}$; $\mu_{10}+\mu_{13}+\mu_{15}\geq 10000$, wherein $P_{15/50}$ is the iron loss at a magnetic induction intensity of 1.5 T at 50 Hz; $\mu_{10}$, $\mu_{13}$, and $\mu_{15}$ are relative magnetic conductivities at induction intensities of 1.0 T, 1.3
(Continued)

T, and 1.5 T at 50 Hz, respectively. The steel plate can be used for manufacturing highly effective and ultra-highly effective electric motors.

4 Claims, 2 Drawing Sheets

(51) Int. Cl.

| | |
|---|---|
| ***C22C 38/60*** | (2006.01) |
| ***C22C 38/00*** | (2006.01) |
| ***C22C 38/02*** | (2006.01) |
| ***C22C 38/04*** | (2006.01) |
| ***C21D 6/00*** | (2006.01) |
| ***C21D 8/12*** | (2006.01) |
| ***H01F 1/16*** | (2006.01) |
| ***B21B 1/00*** | (2006.01) |
| ***C21D 9/46*** | (2006.01) |

(52) U.S. Cl.
CPC ..... *C21D 8/1233* (2013.01); *C21D 8/1261* (2013.01); *C21D 8/1272* (2013.01); *C21D 9/46* (2013.01); *C22C 38/004* (2013.01); *C22C 38/008* (2013.01); *C22C 38/02* (2013.01); *C22C 38/04* (2013.01); *C22C 38/06* (2013.01); *C22C 38/60* (2013.01); *H01F 1/16* (2013.01); *C22C 38/001* (2013.01); *H01F 1/14791* (2013.01)

(56) References Cited

FOREIGN PATENT DOCUMENTS

| | | | |
|---|---|---|---|
| CN | 101906577 A | * | 12/2010 |
| JP | 02073919 A | * | 3/1990 |
| WO | 2009/142401 A1 | | 11/2009 |

OTHER PUBLICATIONS

PCT International Search Report for PCT Application No. PCT/CN2012/000382 mailed Dec. 27, 2012 (6 pages).
Office Action for Chinese Patent Application No. 201210068984.8 dated Sep. 28, 2014.
Observations regarding Office Action for Chinese Patent Application No. 201210068984.8 dated Sep. 28, 2014.

* cited by examiner

NON-ORIENTED ELECTRICAL STEEL PLATE AND MANUFACTURING PROCESS THEREFOR

CROSS REFERENCE TO RELATED APPLICATIONS

This application claims the priority benefit of PCT/CN2012/000382 filed on Mar. 27, 2012 and Chinese Application No. 201210068984.8 filed on Mar. 15, 2012. The contents of these applications are hereby incorporated by reference in their entirety.

TECHNICAL FIELD

The present invention belongs to the metallurgy field. Particularly, the present invention relates to a non-oriented electrical steel sheet and its manufacturing method, and specifically a non-oriented electrical steel sheet characterized by low production cost, low iron loss and high magnetic permeability and applicable for industrial motors and its manufacturing method.

BACKGROUND TECHNOLOGY

With the requirements for energy conservation becoming increasingly rigorous in various countries in the world, more rigorous requirements are put forward with respect to the efficiency and energy conservation of motors. In order to improve the efficiency of motors, their loss must be reduced. The loss of motors can be roughly divided into copper loss of stators and rotors, basic iron loss, mechanical loss and stray loss, among which copper loss and iron loss respectively account for about 40% and 20% of the total loss and are both related to the magnetic induction and magnetic permeability of electrical steel sheets, which are the materials used for manufacturing motors. Given that improving the magnetic induction and magnetic permeability of electrical steel sheets can help to reduce the copper loss and iron loss, the non-oriented electrical steel sheet featured by low iron loss and high magnetic permeability has become the preferred material for making high-efficiency motors.

Generally, Si, Al and other relevant elements are added to increase the electrical resistivity of materials and thereby reduce iron loss. For example, the Japanese patent JP-A-55-73819 discloses that, by adding an appropriate amount of Al and adjusting the annealing atmosphere, the internal oxide layer on steel sheet surface can be reduced, thereby achieve excellent magnetic performance. Similarly, Japanese patents JP-A-54-68716 and JP-A-61-87823 disclose that, adding Al or REM or optimizing the cooling rate of annealing can also improve magnetic performance.

However, adding only Si, Al and other relevant elements, or simultaneously employing corresponding process optimization to improve magnetic performance can achieve a very limited effect, because, as is well known, adding Si and Al would lower the magnetic induction and magnetic permeability of electrical steel sheets and thus reduce the efficiency of motors.

The U.S. Pat. No. 4,545,827 discloses a method for manufacturing a non-oriented electrical steel sheet featured by low iron loss and high magnetic permeability, wherein C content (wt %) is adjusted to control the carbide precipitation of products and the temper rolling technique is adopted to obtain 3.5-5.0 ASTM ferrite grain and easily magnetizable texture ingredients. However, the ingredient system of the patent is characterized by low Si and high C, and high C content may easily lead to magnetic aging and increased iron loss.

The U.S. Pat. No. 6,428,632 discloses a non-oriented electrical steel with low anisotropy and excellent processing property and applicable in high-frequency areas. The patent requires that the properties of steel sheets to satisfy the conditions of formulas $B_{50}$ (L+C)≥0.03$W_{15/50}$(L+C)+1.63 and $W_{10/400}$(D)$W_{10/400}$(L±C)≤1.2, so as to manufacture motors with high efficiency (above 92%). However, the non-oriented electrical steel manufactured with the patent technology is mainly used for high-frequency rotary motors, which require high production cost and thus not applicable for ordinary industrial motors.

Therefore, developing non-oriented electrical steel sheets with low production cost, low iron loss and high magnetic permeability and applicable for industrial motors has presented a broad market prospect. For this purpose, the present inventors have designed the research protocol on the basis of the following idea: By controlling the air cooling time and final rolling temperature of the hot rolling process and coarsening the inclusions in the steel, both the recrystallization percentage and grain size of the hot-rolled sheet are increased, so as to obtain non-oriented electrical sheets with low iron loss and high magnetic permeability and thereby produce non-oriented electrical steel sheets which can be used to improve the efficiency of ordinary industrial motors as well as high-efficiency and super high-efficiency industrial motors. Particularly, the present invention relates to a non-oriented electrical steel sheet which is applicable for manufacturing industrial motors with a working magnetic flux density of 1.0~1.6 T and can improve the efficiency of the motors by 1%.

SUMMARY OF THE INVENTION

Therefore, an object of the present invention is to provide a non-oriented electrical steel sheet, the casting slab of which comprises:

Si: 0.1~2.0 wt %; Al: 0.1~1.0 wt %; Mn: 0.10~1.0 wt %; C: ≤0.005 wt %; P: ≤0.2 wt %; S: ≤0.005 wt %; N: ≤0.005 wt %; and balance being Fe and other unavoidable impurities, and the magnetic permeability of the steel sheet satisfies the following formulas (1) and (2):

$$\mu_{10}+\mu_{13}+\mu_{15}\geq 13982-586.5P_{15/50} \quad (1);$$

$$\mu_{10}+\mu_{13}+\mu_{15}\geq 10000 \quad (2),$$

wherein, $\mu_{10}$, $\mu_{13}$ and $\mu_{15}$ respectively represent the relative magnetic permeability at magnetic inductions of 1.0 T, 1.3 T and 1.5 T at 50 Hz; $P_{15/50}$ represents the iron loss at 50 Hz and under a magnetic induction of 1.5 T; when calculating the formula (1), $P_{15/50}$ is calculated as a dimensionless numerical value, regardless of its actual unit (W/kg).

It is preferable that the magnetic permeability of the steel sheet satisfies the following formula (3):

$$\mu_{10}+\mu_{13}+\mu_{15}\geq 11000 \quad (3).$$

In said steel sheet, Sn and/or Sb may be selectively added based on actual circumstances, and their total content should be controlled to be ≤0.3 wt %.

In other words, the present invention provides a non-oriented electrical steel sheet, the casting slab of which comprises:

Si: 0.1~2.0 wt %; Al: 0.1~1.0 wt %; Mn: 0.10~1.0 wt %; C: ≤0.005 wt %; P: ≤0.2 wt %; S: ≤0.005 wt %; N: ≤0.005 wt %; either or both of Sn and Sb: ≤0.3 wt %; and balance being Fe and other unavoidable impurities, and the magnetic permeability of the steel sheet satisfies the following formulas (1) and (2):

$$\mu_{10}+\mu_{13}+\mu_{15}\geq 13982-586.5P_{15/50} \quad (1);$$

$$\mu_{10}+\mu_{13}+\mu_{15}\geq 10000 \quad (2),$$

wherein, $\mu_{10}$, $\mu_{13}$ and $\mu_{15}$ respectively represent the relative magnetic permeability at magnetic inductions of 1.0 T, 1.3 T and 1.5 T at 50 Hz; $P_{15/50}$ represents the iron loss at 50 Hz and under a magnetic induction of 1.5 T; when calculating the formula (1), $P_{15/50}$ is calculated as a dimensionless numerical value, regardless of its actual unit (W/kg).

Another object of the present invention is to provide a method for manufacturing said non-oriented electrical steel sheet, and which includes steelmaking, hot rolling, acid pickling, cold rolling and annealing in sequence.

Preferably the manufacturing method of the present invention omits the normalizing treatment process of the hot-rolled sheet.

Preferably the final rolling temperature (FDT) of the hot rolling process in the manufacturing method of the present invention satisfies the formula (4):

$$830+42\times(Si+Al)<FDT<880+23\times(Si+Al) \quad (4).$$

Wherein, Si and Al respectively represent the weight percentages of elements Si and Al, and the unit of FDT is degree Celsius (° C.).

Preferably the nominal grain size D of the hot-rolled sheet in the manufacturing method of the present invention is greater than 30 μm; wherein, D=R×d, R represents recrystallization percentage, and d represents the mean recrystal grain size of the hot-rolled sheet.

Preferably, in the manufacturing method of the present invention, the time interval $t_1$ between the end of rough rolling of the intermediate slab and the start of the finishing rolling of it on F1 frame in the hot rolling process is controlled to be 20 sec. or more, and the time interval $t_2$ between the end of finishing rolling of the intermediate slab and the start of its laminar cooling process is controlled to be 5 sec. or more.

Preferably the steel sheet of the present invention may be used to manufacture industrial motors, especially high-efficiency and super high-efficiency industrial motors.

The non-oriented electrical steel sheet of the present invention has the advantages of low production cost, low iron loss and high magnetic permeability, which is a material with high cost performance when used to manufacture industrial motors. Furthermore, in the manufacturing method of the present invention, the normalizing treatment of the hot-rolled sheet can be omitted by improving the process conditions of other steps, which shortens the processing flow and correspondingly reduces the production cost of the non-oriented electrical steel sheet and obtains products with low iron loss and excellent magnetic performance. The experiment indicates that, as compared with the motors made of conventional non-oriented silicon steel products, the motors made of products manufactured through the present invention can obtain an efficiency improvement of at least 1%, and significantly save the electric energy.

EMBODIMENTS

The technical proposal of the present invention is elaborated below by combining the attached figures.

Definitions

Intermediate Slab

The steel slab obtained after the rough rolling and before the finishing rolling in the hot rolling process of the steel sheet.

F1 Frame

The first rolling mill in the finishing rolling mill series. A typical finishing rolling mill series is constituted by seven rolling mills, called F1-F7 for short.

Nominal Grain Size

The index used to describe the grain size and recrystallization percentage in the present invention, represented by D; wherein, D=R×d, R represents recrystallization percentage, and d represents the mean recrystal grain size of the hot-rolled sheet.

Principle of the Present Invention

Figure 1:
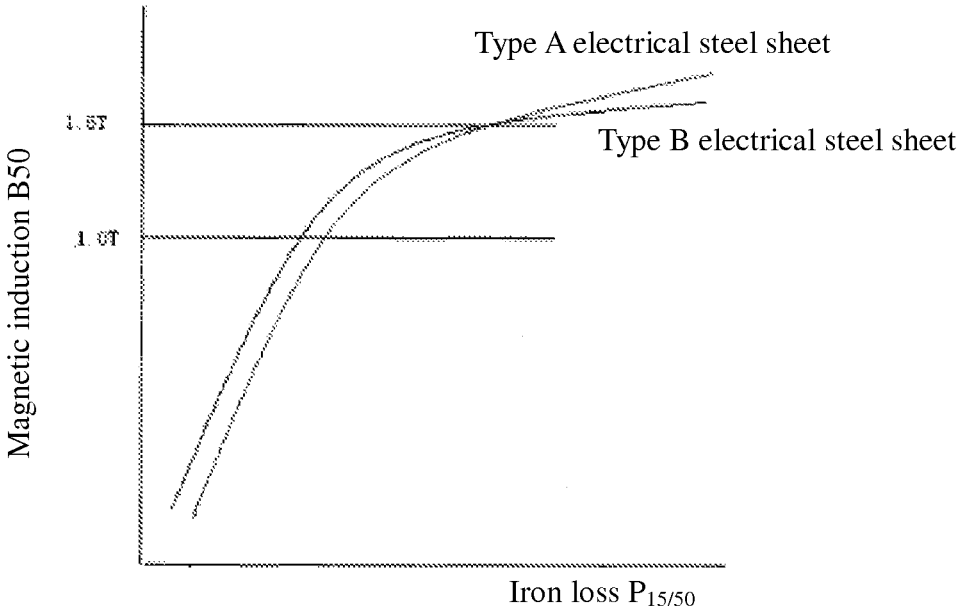
FIG. 1 is a schematic diagram showing the correlation between $\mu_{10}+\mu_{13}+\mu_{15}$ and $P_{15/50}$ of the non-oriented electrical steel sheet and the motor efficiency.

Motor efficiency is closely related to the iron loss P and magnetic induction B of the non-oriented electrical steel as the manufacturing material, however, the iron loss P and magnetic induction B are a pair of contradictory parameters. In the research on the correlation between motor efficiency and the magnetic performance of electrical steel sheets, the present inventors have used various brands of electrical steel sheets to manufacture various types of industrial motors. As shown in the research, ordinary industrial motors usually have a working magnetic induction of 1.0 T~1.6 T, which means that their working range cannot reach the magnetic induction of material $B_{50}$ in normal circumstances, so the judgment of motor efficiency cannot be made simply by evaluating the magnetic performance of electrical steel sheets through $B_{50}$ level. For example, with $P_{15/50}$ remaining the same, when $B_{50}$ of type A electrical steel=1.75 T and $B_{50}$ of type B electrical steel=1.70 T, the motors made of type A electrical steel seem to be more energy-saving and efficient. However, the situation as described in FIG. 1 may occur actually. In other words, under the premise that motors are designed in the same manner, the motors made of type B material will be more efficient than those made of type A material.

Figure 2:
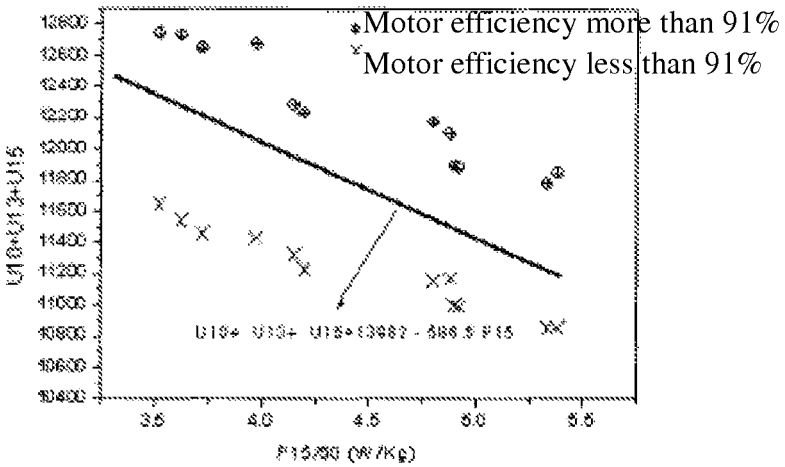
FIG. 2 is the curve chart of the iron loss $P_{15/50}$ of type A electrical steel sheet and type B electrical steel sheet relative to magnetic induction $B_{50}$.

FIG. 2 is a schematic diagram showing the correlation between the $\mu_{10}+\mu_{13}+\mu_{15}$ and $P_{15/50}$ of the non-oriented electrical steel sheet and the motor efficiency. The motor used is 30 kW−2 motor. As shown in FIG. 2, when the magnetic permeability ($\mu_{10}+\mu_{13}+\mu_{15}$) and iron loss $P_{15/50}$ of the non-oriented electrical steel satisfy the following formulas (1) and (2), the motor efficiency is significantly improved:

$$\mu_{10}+\mu_{13}+\mu_{15}\geq 13982-586.5P_{15/50} \quad (1);$$

$$\mu_{10}+\mu_{13}+\mu_{15}\geq 10000 \quad (2),$$

Wherein, when calculating the formula (1), $P_{15/50}$ is calculated as a dimensionless numerical value, regardless of its actual unit (W/kg).

Relation between the magnetic performance of electrical steel and the grain structure.

Figure 3:
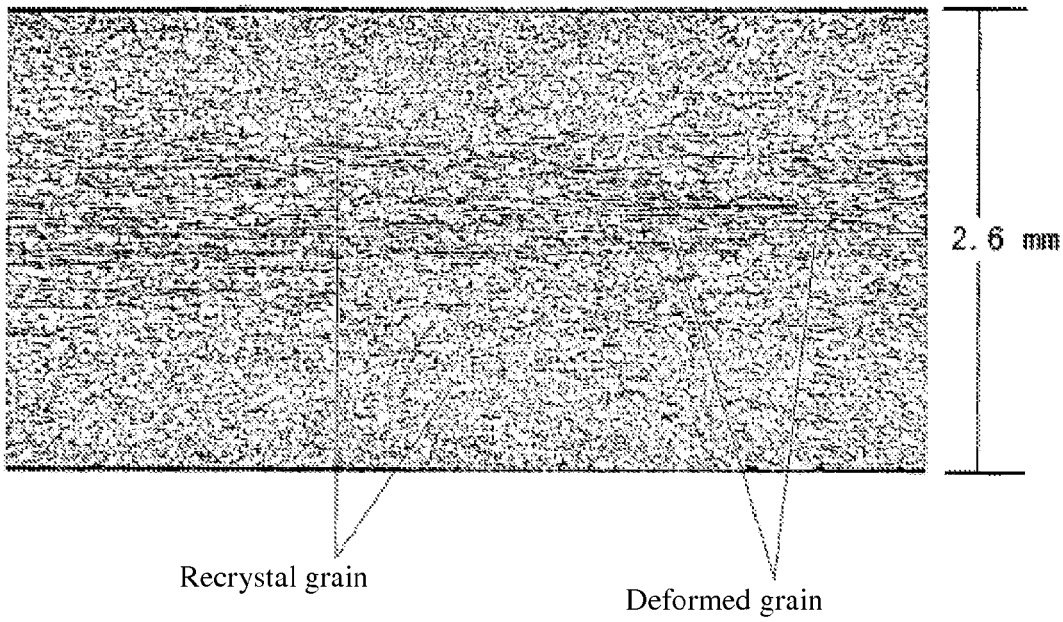
FIG. 3 is the picture of metallographic microstructure of the hot-rolled sheet.

The present invention has studied in depth the influence of the hot rolling process on the magnetic permeability of the final steel strip product, and found that there is a significant correlation between the grain structure size of the hot-rolled sheet and the magnetic permeability of the electrical steel sheet. During the hot rolling of the non-oriented silicon steel, on the one hand, there is a relatively high frictional force between the steel sheet and the roller, which results in multiple restraints, complex stress and strain statuses and high accumulative stored energy on the surface of the steel sheet; on the other hand, the temperature on the surface of the steel sheet is lower than that in the center, the multiplication rate of surface stored energy is accelerated, the dynamic recovery rate is low, and the energy consumption rate is low, so as to meet the energy condition for dynamic recrystallization and form tiny dynamic recrystal grain structures; in the center, the dynamic recovery rate is high, accumulative stored energy is low, the recrystallization power is low, so it's insufficient to result in the dynamic recrystallization, and the structures after final rolling are mainly deformed grains, as shown in FIG. 3.

Since the temperature after the final rolling of the steel sheet is relatively high, the static recovery and recrystallization as well as grain growth usually occur during the subsequent air cooling process. The static recovery rate is related to the deformation stored energy, stacking fault energy and temperature: the higher the deformation stored energy, the stacking fault energy and the temperature are, the higher the static recovery rate is. The static recrystallization rate is related to the static recovery degree, the grain boundary migration difficulty and the temperature: the more adequate the static recovery, the more difficult the grain boundary migration and the lower the temperature are, the lower the static recrystallization rate is (even it's impossible for recrystallization to occur).

On the whole, the grain structure of silicon steel hot-rolled sheets is mainly determined by the dynamic recovery, dynamic recrystallization, static recovery, static recrystallization, grain growth and other procedures; the structure distribution from the surface to the center in the thickness direction (cross section) of steel sheets is: on the surface are mainly the further static recovery structures of dynamic recrystal grains; in the center are mainly the further static recovery or static recrystal structures of dynamically-recovered deformed grains; in the transitional zone from the surface to the center are mainly the further static recovery or static recrystal structures of partial dynamically-recovered deformed grains and partial dynamic recrystal grains.

Based on said recrystallization mechanism, the present inventors have explored many process conditions directly related to the recrystallization and grain size in the hot rolling process, and made the improvements and limitations on some conditions such as the final rolling temperature (FDT), the retention time of the intermediate slab between the end of rough rolling and the start of F1 frame, the retention time before laminar cooling process, etc., so as to ensure the recrystallization percentage and grain coarsening of the steel sheet and thereby achieve excellent magnetic performances.

In order to characterize the relation between the magnetic performance of electrical steel and the grain structure of hot-rolled sheet, the present inventors have defined the grain size of hot-rolled sheet as shown in FIG. 3, and proposed the concept of "nominal grain size of hot-rolled sheet". In the present invention, the nominal grain size of the hot-rolled sheet is D=R×d, wherein, R represents the recrystallization percentage, and d represents the mean recrystal grain size of the hot-rolled sheet.

It can be known from the above formula that, the recrystallization percentage is directly in proportion to the nominal grain size. As found in the research, the higher the nominal grain size of the hot-rolled sheet is, the higher the magnetic permeability of the electrical steel sheet is.

In order to maintain the low iron loss advantage of the steel sheet within the working magnetic induction range of 1.0 T~1.6 T of ordinary industrial motors, the retention time of the intermediate slab between the end of rough rolling and the start of F1 frame, the retention time after F7 frame processing and before laminar cooling process and the final rolling temperature may be optimized in the hot rolling of the steel sheet, so as to ensure the recrystallization percentage and grain coarsening of the steel sheet.

In order to achieve a high magnetic permeability, the nominal grain size of the hot-rolled sheet in the present invention is no less than 30 μm. On the other hand, the nominal grain size of the hot-rolled sheet in the present invention is no more than 200 μm.

Ingredients of Electrical Steel

In the present invention, different ingredients of the non-oriented electrical steel sheet have different influences on the iron loss and magnetic performance of the electrical steel respectively, and the casting slab of the steel sheet comprises:

Si: soluble in ferrite to form a substitutional solid solution, improve the resistivity of the substrate and reduce the iron loss, it is one of the most important alloying elements in the electrical steel. However, Si may impair magnetic induction, and when Si content is continuously increased after it has reached a certain level, the effect of Si for reducing iron loss will be weakened. In the present invention, Si content is limited to 0.1%~2.0%. If it is higher than 2.0%, it will be difficult to make the magnetic permeability of the electrical steel meet the requirements of high-efficiency motors.

Al: it is soluble in ferrite to improve the resistivity of the substrate, and can coarsen grains and reduce iron loss, and also deoxidate and fix nitrogen, but it may easily cause the oxidation inside the surface of finished steel sheet products. An Al content of above 1.5% will make the smelting, casting and processing difficult and may reduce the magnetic induction.

Mn: similar to Si and Al, it can improve the resistivity of steel and reduce iron loss; in addition, Mn can bond with the unavoidable impurity element S to form stable MnS and thereby eliminate the harm of S on the magnetic property. In addition to preventing the hot shortness, it's also soluble in ferrite to form substitutional solid solution and reduces the iron loss. Thus, it's necessary to add Mn at least in an amount of 0.1%. In the present invention, Mn content is limited to 0.10%~1.50%. If Mn content is lower than 0.1%, the above beneficial effects are not obvious; if Mn content is higher than 1.50%, it will reduce both the Acl temperature and the recrystallization temperature, lead to α-γ phase change in thermal treatment, and deteriorate the beneficial texture.

P: adding a certain amount of phosphorus (below 0.2%) into steel can improve the workability of the steel sheet, however, if its content exceeds 0.2%, the workabilityof the steel sheet in cold rolling may be impaired.

S: harmful to both the workability and the magnetic property, it tends to form fine MnS particles together with Mn, hinder the growth of annealed grains of finished products and severely deteriorate magnetic property. In addition, S tends to form low-melting-point FeS and $FeS_2$ or eutectic together with Fe and cause the problem of hot processing brittleness. In the present invention, S content is limited to 0.005% or less; if its content exceeds 0.003%, it will significantly increase the amount of MnS and other S compounds precipitated, seriously hinder the growth of grains and increase iron loss. Preferably the S content is controlled to 0.003% or less in the present invention.

C: harmful to both the workability and the magnetic property, it tends to form fine MnS particles together with Mn, hinder the growth of annealed grains of finished products and severely deteriorate magnetic property. In addition, S tends to form low-melting-point FeS and $FeS_2$ or eutectic together with Fe and cause the problem of hot processing brittleness. In the present invention, S content is limited to 0.005% or less; if its content exceeds 0.003%, it will significantly increase the amount of MnS and other S compounds precipitated, seriously hinder the growth of grains and increase iron loss. Preferably the S content is controlled to 0.003% or less in the present invention.

N: it tends to form fine dispersed nitrides such as AlN, etc., seriously hinder the growth of grains and deteriorate iron loss. In the present invention, N content is limited to 0.002% or less; if its content exceeds 0.002%, it will significantly increase the amount of AlN and other N compounds precipitated, greatly hinder the growth of grains and increase iron loss.

Sn, Sb: as activating elements, when segregated on the surface or at the surface grain boundary, they can reduce the oxidation inside the surface, prevent active oxygen from permeating into the steel substrate along the grain boundary, improve the texture, increase [100] and [110] ingredients and decrease [111] ingredient, and significantly improve the magnetic permeability. In the non-oriented electrical steel of the present invention, it is preferable to comprise one of Sn and Sb or both of them. When the total amount of Sn and Sb falls within the range of 0.04%~0.1%, the magnetic performance can be significantly improved.

Fe: primary ingredient of the electrical steel.

Unavoidable impurities: substances which cannot be completely eliminated under current technical conditions or from the economic perspective and are allowed to exit in certain contents. By means of coarsening impurities in the electrical steel or facilitating their participation in the grain formation, the magnetic performance of the electrical steel may be improved.

Manufacturing Process of the Electrical Steel

The non-oriented electrical steel sheet of the present invention with low production cost, low iron loss and high magnetic permeability is manufactured by limiting its ingredients and improving its processing technology.

Generally, a typical process for manufacturing a non-oriented electrical steel product basically includes the following steps:

1) Steelmaking process: including bessemerizing, RH refining and continuous casting, with the thickness of the continuous casting slab generally being 200 mm~300 mm. The ingredients, impurities and micro structures of the products can be strictly controlled by means of the above process. Besides, this step also helps to control the unavoidable impurities and residual elements in the steel at a relatively low level, reduce the content of inclusions in the steel, coarsen these inclusions and obtain the casting slab with a high equiaxed grain rate at a rational cost in accordance with the requirements of various types of products.

2) Hot rolling process: including the heating, rough rolling, finishing rolling, laminar cooling and coiling of casting slabs made of various types of steel from step 1) at various temperatures below 1,200° C., so as to obtain hot rolls which can satisfy the requirements of the final products on both performance and quality excellence. The hot roll products are generally 1.5 mm~3.0 mm in thickness.

Wherein, in the interval between the end of rough rolling and the start of finishing rolling, the intermediate slab needs to go through a process which includes the transmission and shelving (or placing in static state) and also involves the recrystallization, grain growth and/or grain deformation. The length of the time interval of such a process may influence the crystallization distribution and the change of the steel sheet. In the present application, such a time interval may also be called "the transmission and shelving time of the intermediate slab between the end of rough rolling and the start of F1 frame" or "the retention time of the intermediate slab between the end of rough rolling and the start of F1 frame", abbreviated as $t_1$.

Besides, in the period after finishing rolling and before laminar cooling, the intermediate slab also needs to go through a process which includes the transmission and shelving (or placing in static state) and also involves the recrystallization, grain growth and/or grain deformation. The length of the time interval of such a process may also influence the crystallization distribution and the change of the steel sheet. In the present application, such a time interval may also be called "the transmission and shelving time before laminar cooling" or "the retention time before laminar cooling", abbreviated as $t_2$.

3) Normalizing and acid pickling process: including the high-temperature thermal treatment through continuous annealing of the hot-rolled sheet from step 2). The normalizing treatment process adopts nitrogen protection and rigorous process control, includes shot blasting and acid pickling process, and produces normalized rolls 1.5 mm~3.0 mm in thickness; the above process may be employed to obtain superior micro structure, texture and surface quality.

4) Cold rolling process: including the reversible rolling or continuous rolling of the normalized sheet from step 3) or the hot-rolled sheet from step 2). Cold-rolled products may be obtained as required by users, such as the cold-rolled products 0.2 mm~0.65 mm in thickness. For products requiring a thickness of 0.15 mm~0.35 mm, the intermediate annealing and secondary cold rolling process may also be adopted as described in step 5).

5) Intermediate annealing and secondary cold rolling process: including the intermediate annealing of the primary cold-rolled products 0.35 mm~0.5 mm in thickness and the cold rolling employed for the subsequent secondary rolling so as to achieve the target thickness, in which the primary cold rolling has a reduction ratio of no less than 20%.

6) Final annealing process: including the continuous annealing of the cold-rolled products from step 4) or step 5) (i.e., including or excluding the intermediate annealing of the secondary cold rolling process). Heating, soaking, cooling and thermal treatment are provided under different atmospheres (nitrogen-hydrogen mixture) to form ideal coarse grains and optimized texture ingredients and obtain excellent magnetic performance, mechanical property and surface insulation for finished products. The finished products of the present invention are steel strips, generally 0.15 mm~0.65 mm in thickness.

Process improvement of the present invention

It is found in the research that, the final rolling temperature (FDT) in the hot rolling process has a direct influence on the nominal grain size of the hot-rolled sheet, and there is an internal relation between the final rolling temperature (FDT) and nominal grain size of the hot-rolled sheet and the constituent ingredients of the steel slab (particularly the Si and Al contents of the steel slab). Many experiments have demonstrated that, when the final rolling temperature (FDT, ° C.) in the hot rolling process satisfies the following formula (4):

$$830+42\times(Si+Al)<FDT<880+23\times(Si+Al) \quad (4)$$

and when $t_1$ and $t_2$ are respectively controlled to be no less than 20 sec. and 5 sec., the nominal grain size of the hot-rolled sheet obtained can reach 30 μm or more.

Figure 4:
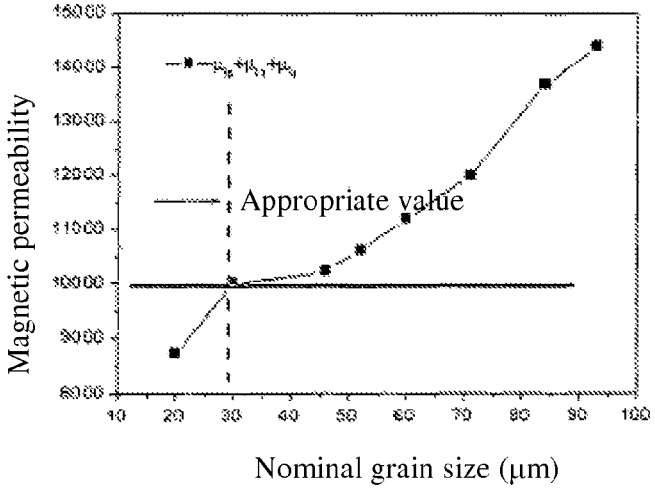
FIG. 4 is a schematic diagram showing the correlation between the grain size of the hot-rolled sheet and the total magnetic permeability ($\mu_{10}+\mu_{13}+\mu_{15}$) of the final steel strip product.

For example, for a steel slab with its basic ingredients being 1.0 wt % Si, 0.32 wt % Al, 0.65 wt % Mn, 0.035 wt % P, <0.0030 wt % C and <0.0020 wt % N, when different retention times and final rolling temperatures are adopted, the hot-rolled structures of different grain sizes through high-temperature coiling at 720° C. are obtained, and after that identical processes are adopted for cold rolling and continuous annealing. FIG. 4 illustrates the relation between the grain size and the magnetic permeability of the hot-rolled sheet obtained. As shown in FIG. 4, only when the nominal grain size of the hot-rolled sheet reaches 30 μm or more, can the finished products achieve a relatively high magnetic permeability.

In the subsequent section we have introduced some specific examples to further explain the present invention. It should be understood that the following examples are introduced to explain the present invention only and not to limit the scope hereof in any way.

EXAMPLES

1. Example I

After the converter process and RH refining treatment, the molten steel is cast into casting slabs, which are then used to manufacture non-oriented electrical steel products through hot rolling, acid pickling, cold rolling, annealing and coating. The process conditions of the traditional manufacturing method are well known by a person skilled in the art. The differences of the present invention from the traditional manufacturing method lies in: 1. The normalizing step is omitted. 2. The magnetic permeability of finished steel strip products is improved by coordinating the standby time and final rolling temperature of the hot rolling process and thereby optimizing the crystallization percentage and nominal grain size of the hot-rolled sheet. Specifically, sheet slabs in the hot rolling process are heated at a temperature of 1,100~1,200° C., and then rolled into 2.6 mm strip steel through hot rolling; the hot-rolled 2.6 mm strip steel is then subject to the cold rolling process to roll them into 0.5 mm strip steel, and then put through the final annealing and coating so as to obtain the steel strip products.

The nominal grain size of the hot-rolled sheet, the relative magnetic permeability $\mu_{10}$, $\mu_{13}$ and $\mu_{15}$ and iron loss $P_{15/50}$ of the finished steel strip products and the efficiency of 30 kW−2 motors are measured, and the results are provided in Table 1.

TABLE 1

| No. | C wt % | Si wt % | Mn wt % | Al wt % | S wt % | Sn wt % | Sb wt % | D μm | $\mu_{10}+\mu_{13}+\mu_{15}$ | $P_{15/50}$ w/kg | Motor efficiency % |
|---|---|---|---|---|---|---|---|---|---|---|---|
| Example 1 | 0.0025 | 0.30 | 0.38 | 0.23 | 0.0019 | tr. | tr. | 59 | 11844 | 5.38 | 91.47 |
| Example 2 | 0.0020 | 0.75 | 0.50 | 0.65 | 0.0020 | 0.04 | 0.02 | 72 | 12025 | 4.92 | 92.6 |
| Example 3 | 0.0018 | 1.0 | 0.22 | 0.31 | 0.0013 | tr. | tr. | 83 | 12173 | 4.88 | 92.14 |
| Example 4 | 0.0023 | 1.30 | 0.22 | 0.31 | 0.0017 | 0.03 | 0.05 | 89 | 12632 | 3.97 | 92.46 |
| Example 5 | 0.0024 | 1.5 | 0.65 | 0.3 | 0.0019 | tr. | 0.05 | 96 | 12822 | 3.72 | 92.85 |
| Comparative Example 1 | 0.0025 | 1.45 | 0.60 | 0.32 | 0.0014 | tr. | 0.048 | 28 | 9653 | 4.01 | 90.15 |

Wherein, the symbol "tr." represents the trace amount or residual amount.

It can be seen from Table 1 that, the $(\mu_{10}+\mu_{13}+\mu_{15})$ value of the finished product in Comparative Example 1 is less than 10000 and does not satisfy the requirements of the formula, and the nominal grain size of the hot-rolled sheet is too small, so the efficiency of 30 kW−2 motors made of it is far lower than that of motors made of the electrical steel materials within the range of the present patent.

Data of Example 1 to Example 5 indicate that, the non-oriented electrical steel sheets of the present invention are featured by low iron loss and high magnetic permeability, and are very applicable for the manufacture of high-efficiency ordinary industrial motors.

2. Example II

After the converter process and RH refining treatment, the molten steel is cast into steel slabs which comprise the following ingredients by the weight percentages as below (except Fe and other unavoidable impurities as the balance): 1.0 wt % Si, 0.32 wt % Al, 0.65 wt % Mn, 0.035 wt % P, <0.0030 wt % C and <0.0020 wt % N. The heating temperature of the hot-rolled sheet slab is controlled at 1160° C. Table 2 shows the changes of the retention time $t_1$ of the intermediate slab between the end of rough rolling and the start of F1 frame, the retention time $t_2$ before laminar cooling and FDT. After high-temperature cooling at 720° C., they are rolled into 2.6 mm strip steel through hot rolling; the hot-rolled 2.6 mm strip steel is then subject to the cold rolling process to roll them into 0.5 mm strip steel, and then put through the final annealing and coating so as to obtain the steel strip products.

The nominal grain size of the hot-rolled sheet, the magnetic permeability and iron loss $P_{15/50}$ of finished products and the efficiency of 30 kW−2 motors are measured, and the results are provided in Table 2.

TABLE 2

| No. | Hot rolling process parameters FDT (° C.) | $t_1$ (s) | $t_2$ (s) | D (μm) | Magnetic property $\mu_{10}+\mu_{13}+\mu_{15}$ | $P_{15/50}$ (w/kg) | Motor efficiency (%) |
|---|---|---|---|---|---|---|---|
| Example 6 | 890 | 24 | 6 | 77 | 12236 | 3.56 | 92.1 |
| Example 7 | 900 | 26 | 7 | 90 | 12315 | 3.43 | 92.4 |
| Example 8 | 910 | 28 | 5 | 87 | 12297 | 3.51 | 92.3 |
| Comparative Example 2 | 820 | 10 | 7 | 25 | 10473 | 4.03 | 90.4 |
| Comparative Example 3 | 890 | 5 | 3 | 20 | 10312 | 4.17 | 89.7 |

It can be seen from Table 2 that, the nominal grain sizes of the hot-rolled sheets are too small in both Comparative Example 2 and Comparative Example 3, so the efficiency of motors thus made are lower than that of motors made of the material of the present invention.

The hot rolling process parameters of Example 6 to Example 8 all fall within the range limited by the present invention, so the motors thus made have high efficiency. Data of Example 6 to Example 8 indicate that, the non-oriented electrical steel sheet of the present invention has low iron loss and high magnetic permeability, and is very applicable for the manufacture of high-efficiency ordinary industrial motors.

Limited examples have been provided above to elaborate the technical proposal of the present invention, and these examples have only demonstrated the verification results of the magnetic permeability of the electrical steel sheet and three parameters ($t_1$, $t_2$ and FDT) in the hot rolling process, however, the present invention can certainly be extended to the improvement of more process conditions, which is very obvious for a person skilled in the art. Thus, under the premise of following the idea of the present invention, various changes or modifications made by the person skilled in the art to the present invention on such basis also fall within the scope of the present invention.

The invention claimed is:

1. A method of producing a non-oriented electrical steel sheet, comprising Si: 0.1~2.0 wt %; Al: 0.1~1.0 wt %; Mn: 0.10~1.0 wt %, C: ≤0.005 wt %; P: ≤0.2 wt %; S: ≤0.005 wt %; N: ←≤0.005 wt %; and balance being Fe and other unavoidable impurities, wherein the method includes steps of steelmaking, hot rolling, acid pickling, cold rolling and annealing in sequence, wherein further, in the hot rolling, a time interval $t_1$ between the end of a rough rolling of an intermediate slab and the start of a finishing rolling in F1 frame is controlled to be →≥20 sec., and the time interval $t_2$ between the end of the finishing rolling of the intermediate slab and the start of a laminar cooling process is controlled to be →≥5 sec.

2. The method according to claim 1, which does not include a normalizing treatment process in the hot rolling of the non-oriented electrical steel sheet.

3. The method according to claim 1, wherein a final rolling temperature (FDT) of the hot rolling process satisfies the following formula (4):

$$830+42x(\mathrm{Si}+\mathrm{Al})<\mathrm{FDT}<880+23x(\mathrm{Si}+\mathrm{Al}) \quad (4)$$

wherein Si and Al respectively represent the weight percentages of elements Si and Al, and the unit of FDT is ° C.

4. The method according to claim 1, wherein a nominal grain size D of the non-oriented electrical steel sheet that has been hot rolled is no less than 30 μm and no more than 200 μm, wherein D=Rxd, and R represents a recrystallization percentage in decimal form, and d represents a mean recrystal grain size of the non-oriented electrical steel sheet that has been hot rolled.

* * * * *